United States Patent [19]

Rinehart

[11] Patent Number: 4,654,896

[45] Date of Patent: Apr. 7, 1987

[54] FINGER PORTION FOR A GLOVE

[75] Inventor: Dixie L. Rinehart, Aspen, Colo.

[73] Assignee: Rinehart Glove, Ltd., Aspen, Colo.

[21] Appl. No.: 706,421

[22] Filed: Feb. 27, 1985

[51] Int. Cl.[4] ..... A41D 19/02

[52] U.S. Cl. ..... 2/163; 2/161 R; 2/169

[58] Field of Search ..... 2/158, 159, 161 R, 161 A, 2/163, 169

[56] References Cited

U.S. PATENT DOCUMENTS

| | | | |
|---|---|---|---|
| Re. 16,609 | 5/1927 | Sturm . | |
| 1,666,023 | 4/1928 | Sturm | 2/169 |
| 2,617,109 | 11/1952 | Slimovitz . | |
| 3,867,727 | 2/1975 | Povlacs . | |
| 4,000,524 | 6/1977 | Rinehart | 2/161 R |
| 4,245,357 | 1/1981 | Connelly | 2/163 |
| 4,441,213 | 4/1984 | Trumble et al. . | |

FOREIGN PATENT DOCUMENTS

| | | |
|---|---|---|
| 154430 | 12/1953 | Australia . |
| 796667 | 4/1936 | France . |

*Primary Examiner*—Werner H. Schroeder
*Assistant Examiner*—J. L. Olds
*Attorney, Agent, or Firm*—Pennie & Edmonds

[57] ABSTRACT

A finger portion for a glove where the portion comprises two superimposed four-pointed star-shaped pattern pieces where each star forms a finger part. Each pattern piece has a cut out. The pattern pieces are joined together around their peripheries by sewing or sealing in the flat where the line of juncture of the pieces is along lines of non-extension of the fingers formed by the finger portion. The finger portions of one pattern piece are longer than that of the other pattern piece and the pattern piece having the longer finger part is folded to form a tuck when joined to its corresponding finger part of the other pattern piece.

6 Claims, 7 Drawing Figures

FINGER PORTION FOR A GLOVE

TECHNICAL FIELD

This invention relates to a finger portion for a glove and more particularly to a finger portion for a glove which may be easily flexed to a curved position by a wearer and which at the same time will allow joining of the parts making up the finger portions while "in the flat" utilizing a minimum of parts requiring a minimum of sewing operations to join the parts.

BACKGROUND OF THE INVENTION

Various forms of glove construction have existed and been proposed over the years to give a comfortable fit to the hands and to accommodate a slightly curved configuration that a hand takes in the relaxed position. Such constructions have required highly skilled labor to shape and assemble the various parts making up such gloves in order to assure an accurate, comfortable and conformal fit when worn.

A problem that has existed with some of these prior art constructions is that they are not adapted for assembly while "in the flat" and in having the seams or seals joining the pieces making up finger portions of the glove extending along lines of non-extension of fingers of the glove. A line of non-extension of a finger of a glove can be defined as a neutral axis extending along the length of a finger formed by finger parts near the middle of a finger which does not compress or stretch upon flexing of the finger.

Glove constructions can be sewn in the flat with seams extending along lines of non-extension if the material making up the finger portions of the glove is highly elastic such as a knitted soft goods fabric and gloves constructed with such finger portions will provide sufficient stretch to accommodate flexing of the fingers of a wearer. However such material usually does not provide good abrasion resistance nor protection to the wearer as relatively inelastic material such as leather, plastic or heavy fabric. In order to provide sufficient flexibility to gloves made of these relative inelastic materials and still provide flexibilty to the fingers of the glove, it has been necessary to add additional parts to the finger portions which increases sewing or joining times and expense.

An example of one construction having extra parts is a "fourchette" high fashion-type glove in which curved side panels or strips of material are sewn between back and palm pieces of each finger to join and shape each finger. The result is that each finger has at least four seams joining four parts. The sewing required to join the parts is difficult because of the complex seam construction utilized and takes a great deal of time. Such construction is not applicable for sewing "in the flat" nor can such construction be formed by sealing the edges of parts together in the flat. Further the seams joining the parts together are not in line with a neutral line of the finger so that the seams are either compressed or stretched upon flexure of the finger.

Other finger portion constructions having extra finger parts and in which in some instances may be joined together in the flat utilize Clute cut and Gunn cut finger patterns. The Clute cut construction requires four separate back sides for each finger to be joined to a palm side of the glove having four finger portions. This construction thus requires assembly of five separate parts involving a multiplicity of separate sewing operations which increases sewing time and expense of manufacture. Gunn cut patterns for finger portions involve joining three separate pieces together in a plurality of separate sewing operations also increasing sewing time.

Glove constructions have been proposed in an attempt to reduce the number of parts thus reducing assembly steps of sewing or joining operations. For example in U.S. Pat. No. Re. 16,609 there is disclosed a finger construction of a glove which comprises a single star-shaped back piece where each point comprises the back side of a finger part. This back piece is joined to a palm piece of a glove having palm side finger portions by stitching the periphery of the star-shaped piece to the palm piece. Seams joining the pieces together do not extend along any lines of non-extension of the fingers and, as shown in the figures of the patent, extend below any line of non-extension with the result that the seams are subject to compression upon flexure of the fingers. Further there is no provision disclosed providing for a construction which will have finger portions slightly curved to accommodate the natural curvature of the fingers when in a relaxed position.

Positioning of seams joining finger parts of a glove at other than at a line of non-extension results in the seams being either compressed or stretched and thus making them more susceptable to moisture intrusion into the interior of the glove. This is particularly true when the seams are stretched. Further prior art finger constructions do not accomodate the full mobility range of the fingers without restriction.

If the glove construction is in the form of a soft fabric or of a pile-like material, and particularly where the glove construction is to form a liner for a glove, seams which are subjected to compression will compress the material adjacent the seams and thus reduce its insulation properties.

It is therefore an object of my invention to provide for a finger construction of a glove which will have a minimum of pieces as compared to standard glove patterns thus requiring less sewing operations to join the pieces.

It is a further object of the invention to provide for a finger portion construction which will accommodate easy flexing of the fingers of the glove.

It is a still further object of my invention to provide for a finger portion construction wherein seams joining the parts making up the finger portions will extend along lines of non-extension such that the seams will not be subjected to compression or stretching forces when the fingers are flexed. At the same time it is an object of the invention to provide for a seam location joining the parts making up the finger portion which is not subject to abrasion and which is positioned in a comparatively protected region between the fingers of the glove.

It is a still further object of the invention to provide for an insulation liner utilizing the finger construction of the invention wherein the seams joining the parts of the finger portions will have a minimum of heat leakage due to any compression of the insulation material.

GENERAL DESCRIPTION OF THE INVENTION

Broadly a finger portion constructed according to my invention is adapted for use with a glove having a palm part and a back part. The finger portion includes two superimposed four-pointed star-shaped pattern pieces where each point comprises a finger part. Each pattern piece has an inner substantially rectangular shaped cutout. The pieces are joined together about their outer peripheries such that one pattern piece forms the palm side of the finger portion and the other pattern piece forms the back side of the finger portion. The pattern piece comprising the back side has longer finger parts than the pattern piece comprising the palm side before the pieces are joined together either by sewing or by sealing around their peripheries. The finger parts of the pattern piece comprising the back side are shortened by folding a part thereof upon itself to form a tuck which extends across the width of a finger part and so that the length of the finger part will be made substantially equal in length to a corresponding finger part of the pattern piece forming the palm side. The widths of the finger parts corresponding to the finger portions of the two pattern pieces are equal such that when the pieces are joined at their peripheries, the junction between the pattern pieces will extend along line of non-extension for each finger. The result is that when the fingers of the glove are flexed, the stitching, in the event that the parts are sewn together, or seal, in the event the parts are sealed together, will not be subjected to any compression or tension forces.

The finger portion as described may be conventionally joined to the back and palm part of a glove by straightening the finger portion such that the edges of the cutouts of both the superimposed pattern pieces will be in substantially straight line whereby they may be joined to the top edges of the back and palm parts.

Preferably the tucked or lapped portion of each finger part forming the back side is secured only at its ends when the two pattern pieces are joined together by sewing or sealing of their outer peripheries. Further it is preferable that the tuck be positioned at a point on the finger part of the back side corresponding substantially to a joint of a finger of a wearer.

The finger portion as described is preferably assembled "in the flat" in a single sewing operation after which the portion may be joined "in the flat" by sealing or sewing to the palm part and back part of a glove.

Where a glove is to be used to provide warmth, as for example a ski glove, it is preferable that a liner be constructed according to the invention of an insulation material, for example a pile-like material, which may then be inserted into an outer shell identically constructed and made of a leather or more wear-resistant material. The placement of the tucks enhances the flexure of the finger portions and, as previously described, the junction around peripheries of pattern pieces comprising the insulation material, being on lines of non-extension, will not subject the insulation material to undue compression when the finger parts are flexed thus reducing its insulation properties.

DESCRIPTION OF THE PREFERRED EMBODIMENTS

Figure 1:
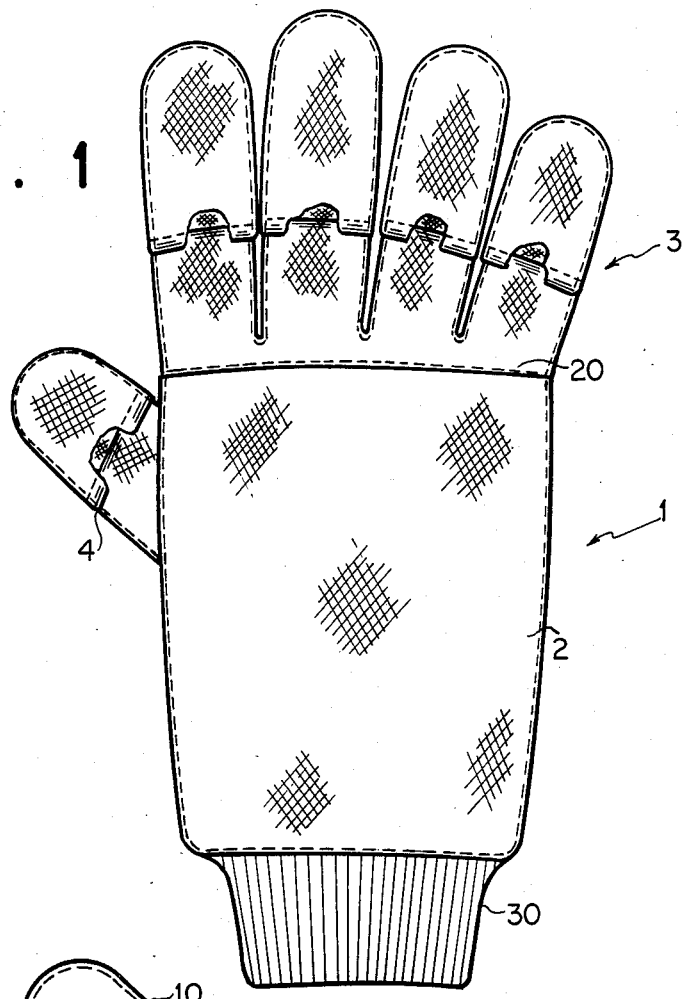
FIG. 1 is a broken plan view illustrating the back side of a right-hand glove having a finger portion constructed according to the invention.

Referring to FIG. 1 there is illustrated a glove 1 constructed according to the invention having a back part 2 overlying a palm part, not shown, and to which is attached a finger portion 3. The palm part also has a thumb portion 4 connected thereto.

Figure 2:
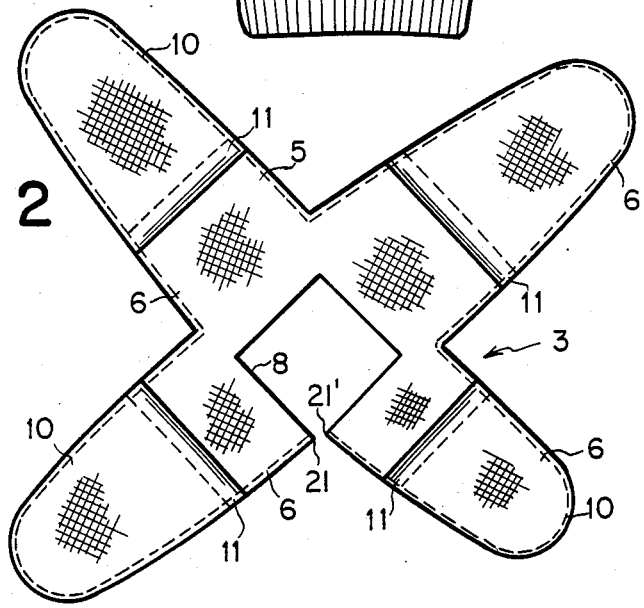
FIG. 2 is a plan view of a pattern piece forming the back side of the finger portion of the glove of FIG. 1.

Referring to FIG. 2 the finger portion 3 comprises in part a four-pointed star-shaped pattern piece 5 where each point forms a finger part 6. The pattern piece 5 has a substantially rectangular shaped cutout 8. The pattern piece 5 forms a back side of the finger portion 3 and overlies a similar shaped separate four-point star-shaped pattern piece, not shown, which forms a palm side of the finger portion. Pattern piece 5 and the pattern piece forming the palm side of the finger portion are joined together around their peripheries as indicated by dotted lines 10 either by stitching or sealing by means of a pressure-sensitive or heat sensitive adhesive.

Figure 3:
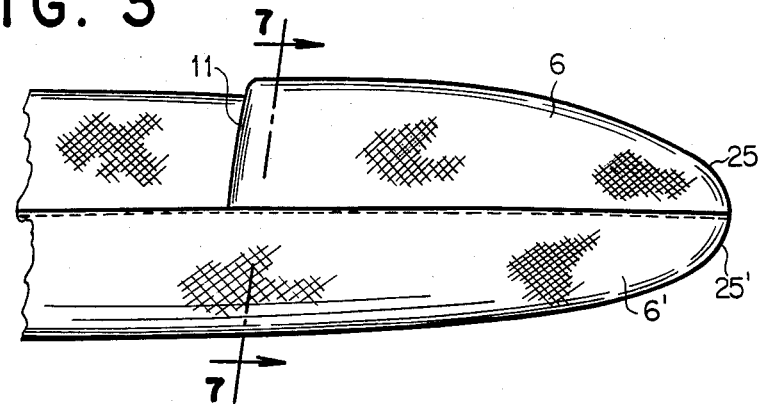
FIG. 3 is an enlarged side view of a finger of the glove of FIG. 1 in a straight unflexed condition.
Figure 4:
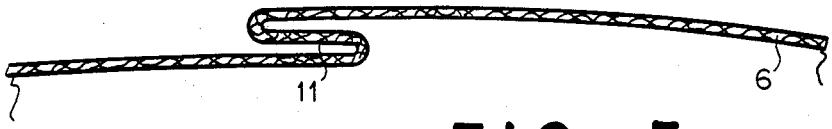
FIG. 4 is an enlarged cross-sectional view of the back side of the finger of FIG. 1.

The length of the finger part 6 of the pattern piece 5 forming the back side of the finger portion is greater than that of the corresponding finger part 6', shown in FIG. 3, of the pattern piece forming the palm side of the finger portion prior to the two pattern pieces being joined together. Upon joining the pieces together, the finger part 6 is folded on itself to form a tuck 11 and to make its length equal to that of the corresponding finger part 6' of the palm patern piece.

On assembly with the back part 2 and palm part covering the hand portion of the glove, the finger portion 3 is straightened so that the finger parts 6 extend approximately parallel to each other and so that the sides of the rectangular cutout 8 of the pattern piece forming the back side of the finger portion as well as that of the cut out of the pattern piece forming the palm side are in a substantially straight line. The finger portion 3 is then joined by stitching or sealing with the substantially straight edges of the cutout 8 being joined to the back part 2 by stitching 20 as shown in FIG. 1 or sealing while the edge of the cutout of the pattern piece forming the palm side is attached in the same manner to the upper edge of the palm part, not shown, of the glove construction.

It is seen by reference to FIGS. 1 and 2 that the joining of the pattern pieces forming the back side and front side of the palm portions as well as the palm part and back part may all be performed "in the flat", that is if the parts are joined by stitching, the seams joining the parts may be made on a flatbed-type sewing machine or by adhesive applied to the periphery of the parts and then sealed by means of a flat hot sealing die. Either method reduces expense of assembly. Further it is seen by reference to FIG. 2 that if stitches are used to join the two pattern pieces together, that it can be performed in one sewing operation. That is the stitching operation may commence at either point 21 or 21' and proceed around the complete periphery of the pattern pieces in one operation without the necessity of stopping and starting a further separate sewing operation.

Figure 7:
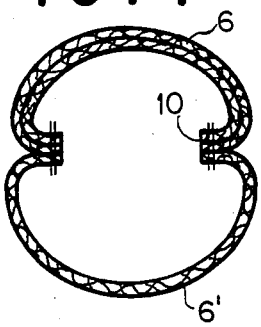
FIG. 7 is a cross-sectional view of the finger of FIG. 3 taken along lines 7—7.

At the same time that the pattern pieces are being sewn together, the finger portion and each finger part 6 is folded to form the tuck 11 and as shown in FIG. 7, the fold is secured only at the ends thereof by the stitching 10. The amount of fold of the finger part 6 is determined by superimposing part 6 onto corresponding part 6' and folding part 6 until the tip 25 of part 6 is in line with tip 25' of part 6' as shown in FIG. 3.

Figure 5:
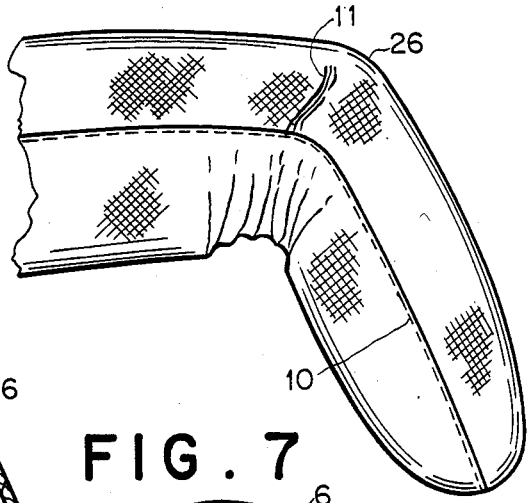
FIG. 5 is a view similar to FIG. 3 illustrating the finger in the flexed or curved condition.
Figure 6:
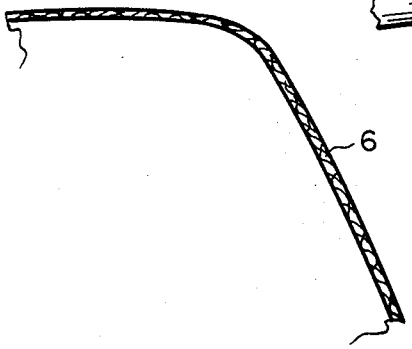
FIG. 6 is a view similar to FIG. 4 of a cross-section of the back side of FIG. 5.

The result of this construction is that when a finger is flexed as shown in FIG. 5 from the straight position as shown in FIG. 3, the finger part 6 of the back side piece will move to pull out the tuck 11 so that at a point farthest from the center of flex, i.e. point 26, the part 6 will tend to smooth out while a portion of the tuck closer to the center of the flexure will still retain some fold. The end result is that the finger part 6 may be easily bent since no forces are needed to stretch the material as occurs in conventional gloves. Thus the fingers of the finger portions may be easily flexed to conform to the natural curved position of fingers of a hand when in a relaxed state.

The width of finger parts 6 is the same as the width of corresponding finger parts 6' throughout their lengths. This assures that when the parts are joined together, that the juncture between the pattern pieces around their outer peripheries will extend along lines of non-extension of each finger part. That is to say, along a line that extends along a neutral line of the finger where there is neither extension of the upper finger part 6 or compression of the lower finger part 6' when the finger is flexed.

This placement of lines of juncture between the finger parts along lines of non-extension further assures that the seams are in a position between or at the sides of the fingers where they are not subject to abrasion or wear as would occur if the seams were on a palm side of the finger portion.

Further placement of the lines of juncture along the line of non-extension reduces any undue forces that might be applied to the juncture upon flexing and straightening of the finger portions. Thus a line of juncture, either a seam or seal, would be subjected to compression forces if below a line of non-extension and would be subjected to tension forces if above the line of non-extension either of which could, over a period of time, weaken the seam or seal, and make it less moisture resistant.

The glove construction of the invention is also applicable for use with inner liners made of an insulation material. As shown in FIG. 1 an inner liner 30 made of a pile-like material is positioned within the glove 1. Preferably the liner 30 is identical in size and construction to glove 1. An advantage of having the liner of the same construction is that the seams of the liner joining palm and back sides of the finger portions will not be subjected to compression forces thus serving to maintain good insulation characteristics and to prevent undue heat loss.

While I have disclosed one method of assembly for joining the finger pattern pieces in the flat, the invention contemplates a further method of assembly where finger part 6 is folded on itself to form a tuck 11 and to make its length equal to that of the corresponding finger part 6', shown in FIG. 3, of the pattern piece forming the palm side of the finger portion and then stitched to the back part 2 along the rectangular cutout 8 in a substantially straight line. The finger part 6' is then seperatley stitched to the palm part 2 along the rectangular cutout 8 in a substantially straight line. All parts of the glove are then joined together by stitching one continous line from one side of the hand portion 2 up and around the outside peripheries of finger portion 3 and down the other side of the hand paortion 2 to the opposite side.

I claim:

1. A finger portion for a glove having a palm part and a back part characterized in that said finger includes two superimposed four-pointed star-shaped pattern pieces with each point comprising a finger part, in that each pattern piece has an inner substantially rectangularly shaped cut out, in that said pieces are joined together about their outer peripheries wherein one pattern piece forms the back side of the finger portion and the other pattern piece forms the palm side of the finger portion, in that the pattern piece comprising the back side has longer finger parts than the pattern piece forming the palm side before being joined thereto, in that each finger part of the pattern piece comprising the back side is shortened by having at least one tuck therein extending across the width of the finger part whereby the length of the finger part may be made substantially equal in length to a corresponding finger part of the pattern piece forming the palm side when the two pattern pieces are joined together at their peripheries, each said tuck comprising a portion of the finger part folded upon itself with the fold secured only at the ends thereof when the two pattern pieces are joined together along their outer peripheries, and in that the junction between the pattern pieces around their outer peripheries extends along lines of non-extension of each finger part.

2. A finger portion for a glove according to claim 1 further characterized in that the edge of the cut out of the pattern piece forming the palm side is adapted to be joined in a substantially straight line configuration to an edge of a palm part of a glove and in that the edge of the cut out of the pattern piece forming the back side is adapted to be joined in a substantially straight line configuration to the edge of a back part of a glove.

3. A finger portion for a glove according to claim 1 further characterized in that a tuck of each finger part of the pattern piece forming the back side is at a position corresponding to substantially the first joint connecting the first and second phalanges of the fingers of a wearer.

4. A finger portion according to claim 1 wherein the pattern pieces are joined together by a single seam stitched in the flat around their outer peripheries.

5. A finger portion according to claim 1 wherein the pattern pieces are joined together in the flat by a seal extending around their outer peripheries.

6. A finger portion for a glove having a palm part and a back part characterized in that said finger includes two superimposed four-pointed star-shaped pattern pieces with each point comprising a finger part, in that each pattern piece has an inner substantially rectangularly shaped cut out, in that said pieces are joined together about their outer peripheries wherein one pattern piece forms the back side of the finger portion and the other pattern piece forms the palm side of the finger portion, in that the pattern piece comprising the back side has longer finger parts than the pattern piece forming the palm side before being joined thereto, and in that each finger part of the pattern piece comprising the back side is shortened by having at least one tuck therein extending across the width of the finger part whereby the length of the finger part may be made substantially equal in length to a corresponding finger part of the pattern piece forming the palm side when the two pattern pieces are joined together at their peripheries, each said tuck comprising a portion of the finger part folded upon itself with the fold secured only at the ends thereof when the two pattern pieces are joined together along their outer peripheries.

* * * * *